US012121159B2

(12) United States Patent
Goehring

(10) Patent No.: US 12,121,159 B2
(45) Date of Patent: Oct. 22, 2024

(54) SPACE SAVING MANUAL SHELF MANAGEMENT SYSTEM

(71) Applicant: William R. Goehring, Wexford, PA (US)

(72) Inventor: William R. Goehring, Wexford, PA (US)

( * ) Notice: Subject to any disclaimer, the term of this patent is extended or adjusted under 35 U.S.C. 154(b) by 0 days.

(21) Appl. No.: 18/108,280

(22) Filed: Feb. 10, 2023

(65) Prior Publication Data

US 2023/0200562 A1 Jun. 29, 2023

Related U.S. Application Data

(63) Continuation of application No. PCT/US2021/045343, filed on Aug. 10, 2021.

(60) Provisional application No. 63/063,768, filed on Aug. 10, 2020.

(51) Int. Cl.
*A47F 1/12* (2006.01)
*A47F 5/00* (2006.01)

(52) U.S. Cl.
CPC ..... *A47F 1/125* (2013.01); *A47F 5/005* (2013.01)

(58) Field of Classification Search
CPC .... A47F 1/125; A47F 5/005; A47F 2005/165; A47B 96/04
USPC ..... 211/59.2, 59.3, 184
See application file for complete search history.

(56) References Cited

U.S. PATENT DOCUMENTS 1,702,987 A * 2/1929 Wilson ..... A47F 1/125 211/59.3
2,079,754 A * 5/1937 Waxgiser ..... A47F 1/125 211/59.3
2,098,844 A * 11/1937 Waxgiser ..... A47B 81/007 211/59.3
4,119,208 A * 10/1978 Acker ..... B65G 1/06 211/162
4,830,201 A * 5/1989 Breslow ..... A47F 1/126 211/59.3
5,123,546 A * 6/1992 Crum ..... A47F 1/126 206/556

(Continued)

FOREIGN PATENT DOCUMENTS

EP 2658417 B1 * 2/2016 ..... A47F 1/00
GB 2486897 A * 7/2012 ..... A47F 1/00

(Continued)

*Primary Examiner* — Jennifer E. Novosad
(74) *Attorney, Agent, or Firm* — Blynn L. Shideler; Krisanne Shideler; BLK Law Group

(57) ABSTRACT

A bottom supporting shelf allocation and management system for allocating shelf space among rows of products comprises a plurality of adjacent shelf allocating and managing units. Each unit is associated with at least one row of products. Each unit includes a base extending to a shelf depth and supporting the row(s) of products, an integral perpendicular side divider attached to the side edge of the base, an open side of the base opposite the base side to which the side divider is attached, a puller that travels in a channel on the base and along the length of the base, a backstop attached to the rear of the puller extending laterally across the surface of the base which is configured to make selectively contact a rearmost product resting on the base and push the row of products on the base forward in sympathy to the puller forward movement.

20 Claims, 5 Drawing Sheets

(56) References Cited

U.S. PATENT DOCUMENTS 5,411,146 A * 5/1995 Jarecki ..... A47F 5/0056 211/184
5,413,229 A * 5/1995 Zuberbuhler ..... A47F 1/125 211/59.3
5,458,248 A * 10/1995 Alain ..... A47B 96/021 211/175
5,469,976 A * 11/1995 Burchell ..... A47F 1/125 211/59.3
5,613,621 A * 3/1997 Gervasi ..... G07F 11/38 221/6
6,155,438 A * 12/2000 Close ..... A47F 1/125 211/DIG. 1
6,227,386 B1 * 5/2001 Close ..... A47F 1/125 211/59.3
6,375,015 B1 * 4/2002 Wingate ..... A47F 1/126 211/59.3
6,527,127 B2 * 3/2003 Dumontet ..... A47F 1/125 211/59.3
6,719,151 B2 * 4/2004 Close ..... A47F 1/12 211/119.003
7,992,726 B2 * 8/2011 Goehring ..... A47F 1/12 211/184
8,066,128 B2 * 11/2011 Crawbuck ..... A47F 1/125 211/59.3
8,113,360 B2 * 2/2012 Olson ..... A47F 5/005 211/59.3
8,851,303 B2 * 10/2014 Crawbuck ..... A47F 1/126 211/59.3
8,997,997 B2 * 4/2015 Close ..... A47F 1/125 206/804
9,055,828 B2 * 6/2015 Burchell ..... A47F 1/125
9,198,527 B2 * 12/2015 Goehring ..... A47F 1/12
9,265,362 B2 * 2/2016 Hardy ..... A47F 1/125
9,398,817 B2 * 7/2016 Daw ..... A47F 1/00
9,907,413 B2 * 3/2018 Goehring ..... A47F 5/0025
10,959,541 B2 * 3/2021 Everett ..... A47F 1/126
11,134,797 B2 * 10/2021 Goehring ..... A47F 5/0025
2002/0145004 A1 * 10/2002 Bennett ..... A47F 5/11 221/311
2005/0098515 A1 * 5/2005 Close ..... A47F 7/28 211/59.3
2006/0076301 A1 * 4/2006 Caterinacci ..... A47F 1/125 211/59.3
2007/0068885 A1 * 3/2007 Busto ..... A47F 1/125 211/59.3
2007/0108083 A1 * 5/2007 Sonon ..... A47F 1/125 206/509
2008/0156752 A1 * 7/2008 Bryson ..... A47F 1/126 211/59.3
2009/0057254 A1 * 3/2009 Crawbuck ..... A47F 1/125 211/162
2014/0124463 A1 * 5/2014 Goehring ..... A47F 5/005 211/49.1
2018/0160823 A1 * 6/2018 Graber ..... A47F 1/126
2018/0249848 A1 * 9/2018 Goehring ..... A47F 5/005
2023/0200562 A1 * 6/2023 Goehring ..... A47F 5/005 211/59.2
2023/0337839 A1 * 10/2023 Walker ..... A47F 1/126

FOREIGN PATENT DOCUMENTS

WO 2006019947 2/2006
WO 2022035823 2/2022
WO WO-2022035823 A1 * 2/2022 ..... A47F 1/125

* cited by examiner

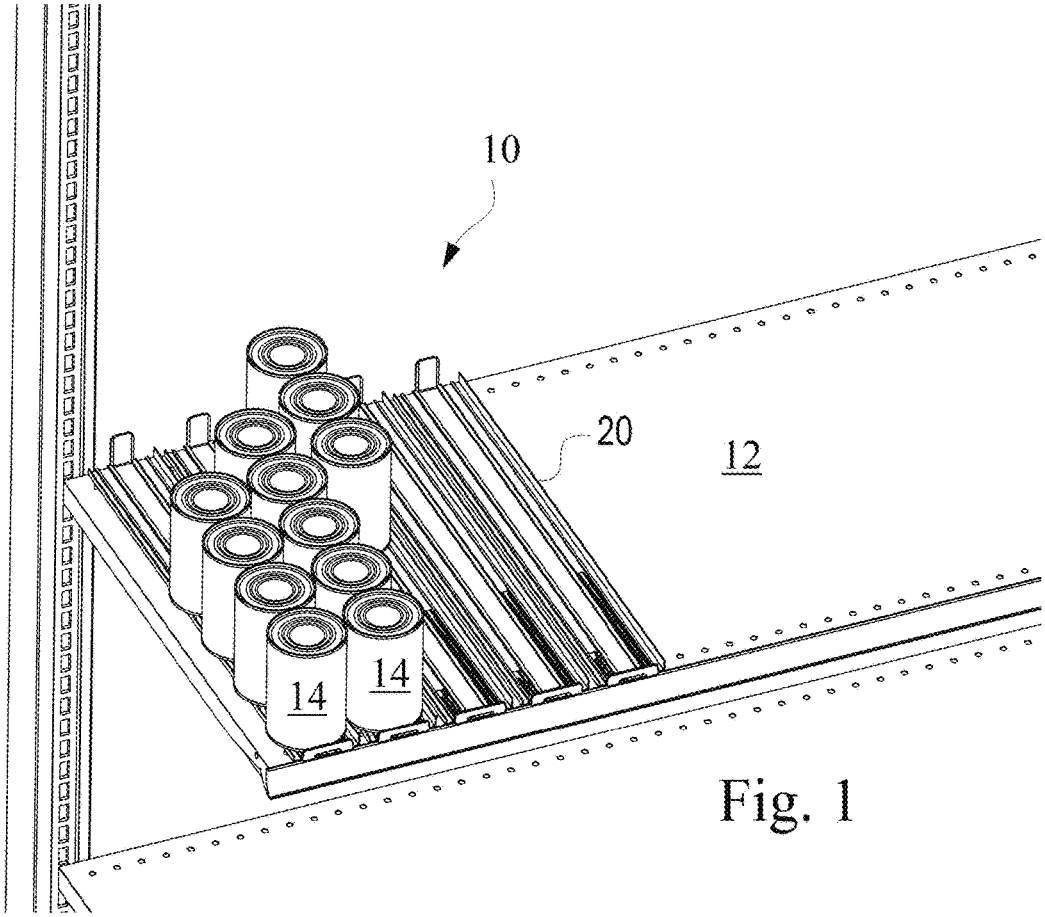
Fig. 1
Fig. 2A
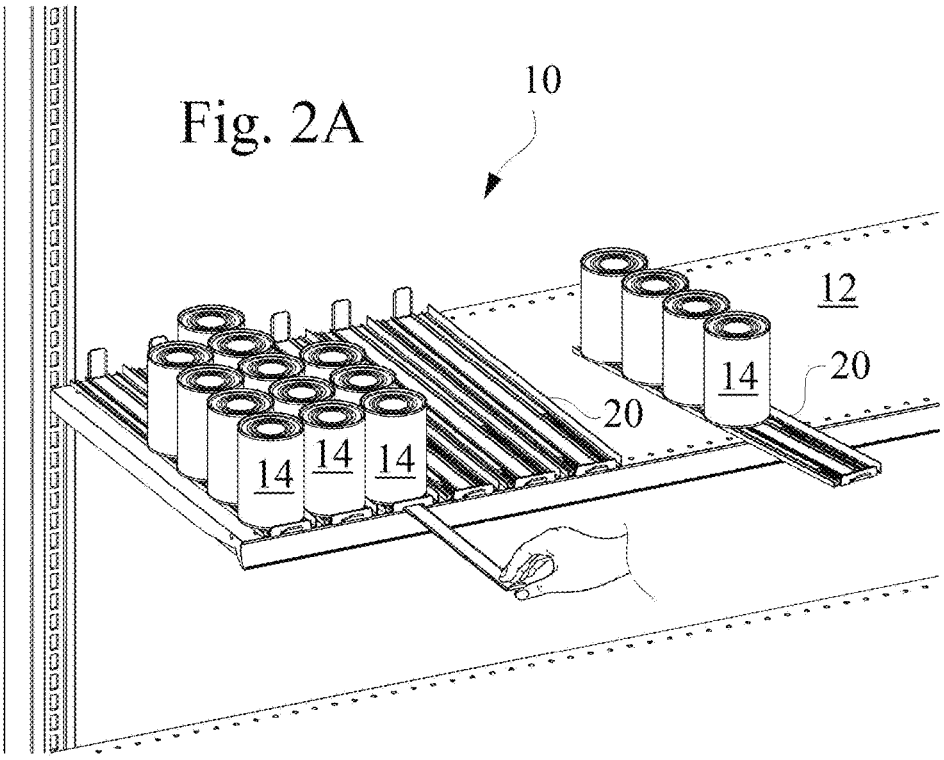

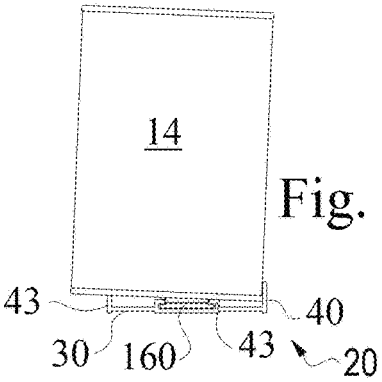
Fig. 4A
Fig. 4B
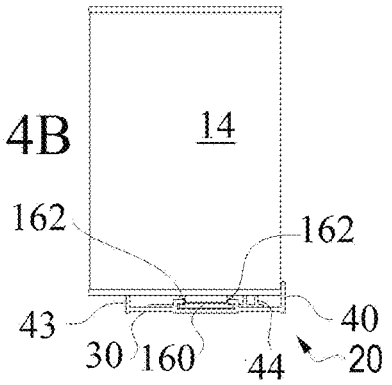
Fig 5A
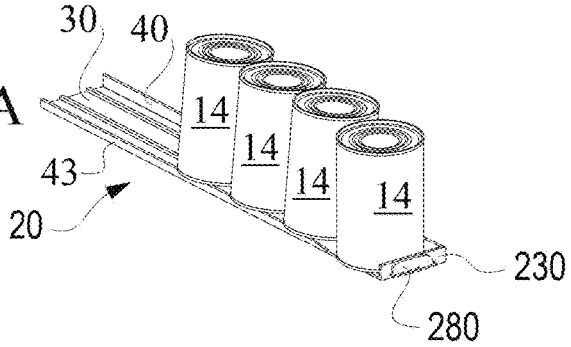
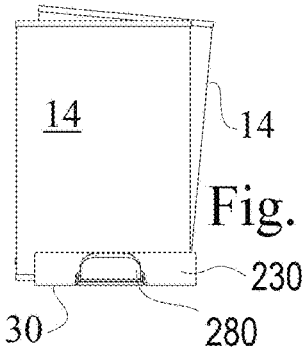
Fig. 5B
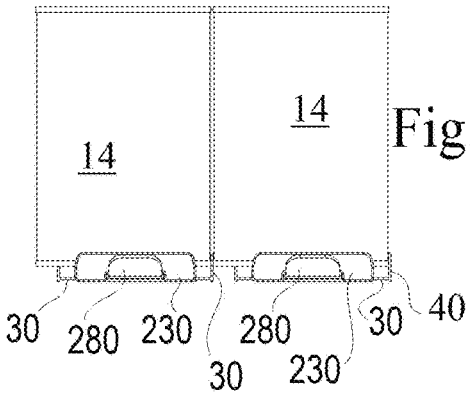
Fig. 6A
FIG. 6B
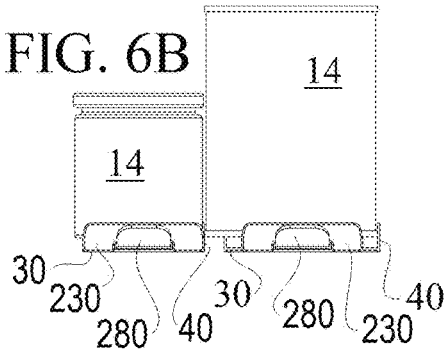
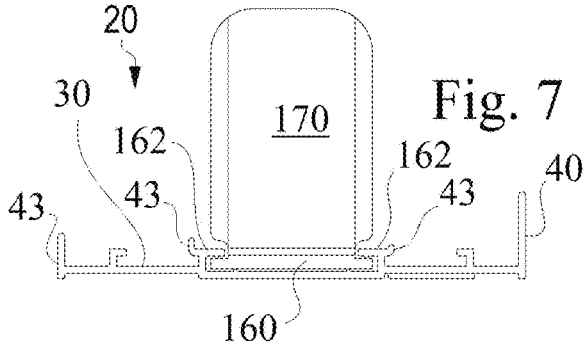
Fig. 7
Fig. 8
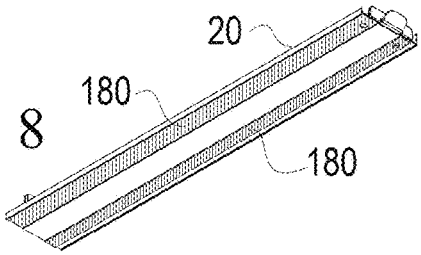

SPACE SAVING MANUAL SHELF MANAGEMENT SYSTEM

RELATED APPLICATIONS

The present invention is a continuation of international application serial number PCT/US2021/045343 filed Aug. 10, 2021 titled Space Saving Manual Shelf Management System" and published Feb. 17, 2022 as publication WO 2022-035823, which application and publication are incorporated herein by reference. Application serial number PCT/US2021/045343 claims the benefit of U.S. Provisional Patent Application Ser. No. 63/063,768 filed Aug. 10, 2020 titled "Space Saving Manual Shelf Management System", which application is incorporated herein by reference.

BACKGROUND OF THE INVENTION

1. Field of the Invention

The present invention relates to manual shelf management systems, and more specifically to a space saving, manual, modular, bottom containing and laterally supporting, substantially extrudable, shelf management system.

2. Background Information

Labor inefficiencies and other problems result when merchandise is displayed on retail shelves with neither rigid dividers nor a method to bring product forward on the shelf into selling position (a process called "fronting") without handling the merchandise piece-by-piece. These problems pertain to grocery stores and other retail stores where consumer packaged goods, such as food products, spray paint cans and health and beauty care products, are displayed for sale on shelves. With no rigid dividers store personnel must, during product stocking, form rows by approximating straight lines and then manually finessing products into straight rows. This process is imprecise and time consuming. Further, as new merchandise is fed into rows from the front of the shelf, packages in the middle of the row tend to move to the left or right (known as "snaking") causing packages in the middle or back of the row to be significantly out of alignment with those at the front. This results in wasted labor as store personnel must handle the merchandise multiple extra times to position products in proper alignment. Another result is shelf disorganization that degrades the shopping experience by making it difficult for shoppers to locate and reach/grasp merchandise. Merchandise is generally selected by the consumer from the front of the shelf and store personnel are constantly fronting the merchandise, i.e. bringing merchandise from the middle and rear of the shelf forward into selling position. The vast majority of store shelves are fronted using the legacy practice where store clerks manually grasp individual packages and pull them forward. This manually intensive practice is time consuming and can be counter-productive because, as the store clerk reaches with his hand into the shelf to grasp packages, adjacent merchandise is sometimes knocked out of position which requires the clerk to then re-position that disrupted merchandise before the fronting procedure is completed. Further, the piece-by-piece fronting method is ineffective as typically only one or two items may be easily brought forward into selling position leaving merchandise at the middle and rear of the shelf out of shopper view and inaccessible.

U.S. Pat. No. 9,907,413 (hereinafter the '413 patent), which is incorporated herein by reference, discloses an effective shelf management system for use on retail store shelves, especially on grocery store shelves. The '413 patent also provides an effective description of prior art shelf management solutions that can be helpful in understanding the state of the art. The system of the '413 patent, which is comprised of individual shelf management units, provides effective row separation, provides lateral support for product rows and allows for easy and rapid row fronting. Further, the '413 patent system maintains straight product rows and establishes positive row separation which together enhance the shopping experience by facilitating product identification and access. Further, the positive row separation prevents co-mingling of products on the shelves (where an item moves from its designated row into a different adjacent row) which causes extra work for store clerks, leads to difficulty in determining how much of a given item is stocked on the shelf, and can lead to items becoming "lost" on the shelf such that they may not sell before their expiration date.

The '413 patent system does not attach to the shelf with mechanical fasteners or permanent adhesives making installation fast and easy. Further, because the '413 patent system is not attached to the shelf, new product cut-ins and merchandise reconfigurations (called re-sets) are easy to accomplish. As the '413 patent system is comprised of individual trays or bases that support individual product rows, re-setting of merchandise is made easier as the units of this system, while loaded with merchandise, can be lifted off and away from the shelf and repositioned on a different shelf location in the store. Further, the '413 patent system is an easy to manufacture, low cost system which is a crucial feature for display systems, as stores will not purchase systems if the systems are expensive.

The '413 patent system could be improved with a design that allows the individual shelf management units of a system to be substantially manufactured by plastic extrusion. Plastic extrusion allows very thin divider wall thicknesses to be manufactured and also allows different lengths of the component parts of a management unit to be easily and cost effectively made, therefore various store shelf depths may be easily accommodated. The features of the '413 patent system lend themselves to manufacturing via injection molding, but not extrusion. Specifically, the design of the channel on the side of the base (within and along which the divider slides forward and backward) requires manufacturing tolerances that cannot be reliably achieved through extrusion and therefore requires injection molding. A new design is therefore needed that maintains the functionality of the '413 system and also enables production substantially via plastic extrusion.

A review of the relevant prior art is also found in U.S. Patent Application publication 2018-0249848 and 2014-0124463; U.S. Pat. Nos. 6,155,438 and 5,613,621 and international publication WO 2006-019947 which are incorporated herein by reference.

It is the object of the present invention to address the deficiencies of the prior art shelf management system, namely to present a '413-type system that may be substantially manufactured by plastic extrusion, and provide a highly effective, very low-cost, easy to install and easy to use shelf management system.

SUMMARY OF THE INVENTION

The present invention maintains all of the advantages presented by the '413 patent shelf management system which are rigid dividers that provide positive row segregation and lateral support to the products, an integral fronting mechanism which allows rapid and complete merchandise fronting, a floating tray design where product rows are positioned on top of the tray thereby allowing product rows to be easily repositioned to the left or right or to be moved to another shelf location altogether, and universality in accommodating merchandise of varying widths so that one size of the shelf management system may be used for a range of different merchandise package widths. A manual shelf management system incorporating all of these features will be referenced herein as a '413 patent type shelf management system.

The object of the present invention are achieved with a bottom supporting shelf allocation and management system for allocating shelf space among rows of products comprising a plurality of adjacent shelf allocating and managing units. Each unit is associated with at least one row of products, wherein each unit includes a base substantially corresponding in length to a depth of a shelf where the base is adapted to rest on the shelf and to support the at least one row of products, an integral perpendicular side divider substantially the same length as the base where the side divider extends vertically above the base and is attached to the side edge of the base and where the coupling of the base and side divider prevents movement of the side divider in relation to the base, a side of the base opposite the side of the base to which the side divider is attached that is open with no side divider, a puller that travels in a channel on the surface of the base and along the length of the base, a backstop attached to the rear of the puller and extending laterally across the surface of the base which is configured, when the puller is manually drawn forward, to make contact with a rearmost product resting on the base and push the rearmost product and any other products on the base forward in sympathy to the forward movement of the puller.

The present invention provides a '413 patent type shelf management system comprised of individual trays featuring a base with integral divider, a puller member that travels in a channel on the top surface of the base, a back-stop attached to the rear of the puller member and longitudinal support rails on the base surface configured to impart a lateral tilt to the products resting on the base whereby the lateral tilt urges the products towards the divider (and away from the open side of the base) thereby helping to prevent the products from falling off of the individual shelf management units.

These and other advantages of the present invention will be clarified in the following description taken together with the accompanying drawings.

BRIEF DESCRIPTION OF THE DRAWINGS

FIG. 1 is a schematic perspective view of the shelf allocation and management system according to one embodiment of the present invention;

FIG. 2A is a schematic perspective view of the shelf allocation and management system of FIG. 1 and showing manual fronting operation of the system and showing the modular nature of the system and a re-setting operation using the system;

FIG. 4A is a schematic front elevation view of the individual shelf allocation and management unit shown in FIGS. 3A and 3B and showing a support rail that extends upward from the base and is configured to tilt products resting on the base towards the divider and further showing a can, positioned at the rear or mid-point of the base, as tilted towards the divider;

FIG. 4B is a schematic front elevation view of the individual shelf allocation and management unit shown in FIGS. 3A and 3B showing a leveling ramp that presents merchandise at the front of the base as level and further shows that a can positioned at the front of the base is level;

FIG. 5A is a schematic perspective view of a shelf allocation and management unit according to one embodiment of the present invention showing a base support rail at full height at the rear and middle of the unit and tapering to flat towards the front of the unit;

FIG. 5B is a schematic front elevation view of the individual shelf allocation and management unit shown in FIG. 5A showing a can at the mid-point (or rear) of the unit as tilted and further shows that a can positioned at the front of the base is level;

FIG. 6A is a schematic front elevation view of two shelf allocation and management units according to one embodiment of the present invention, where the two units are the same width, showing a portion of the left side of the products hanging off the left edge of the unit and further showing that only a single divider separates the two products;

FIG. 6B is a schematic front elevation view of two shelf allocation and management units according to one embodiment of the present invention, where the two units are different widths, showing a portion of the left side of the products hanging off the left edge of the unit and further showing that only a single divider separates the two products;

FIG. 7 is a schematic sectional elevation view of a shelf allocation and management system according to one embodiment of the present invention and showing the system of support rails that impart a lateral tilt to the products, and the two overhang features of the puller channel that allow the puller to slide forwards and backwards but prevent the puller from moving upwards, and also showing the puller and attached back-stop;

FIG. 8 is a schematic view of the underside of shelf allocation and management units showing the magnets that help keep the individual units in proper position on a steel shelf;

DESCRIPTION OF THE PREFERRED EMBODIMENTS

Figure 2B:
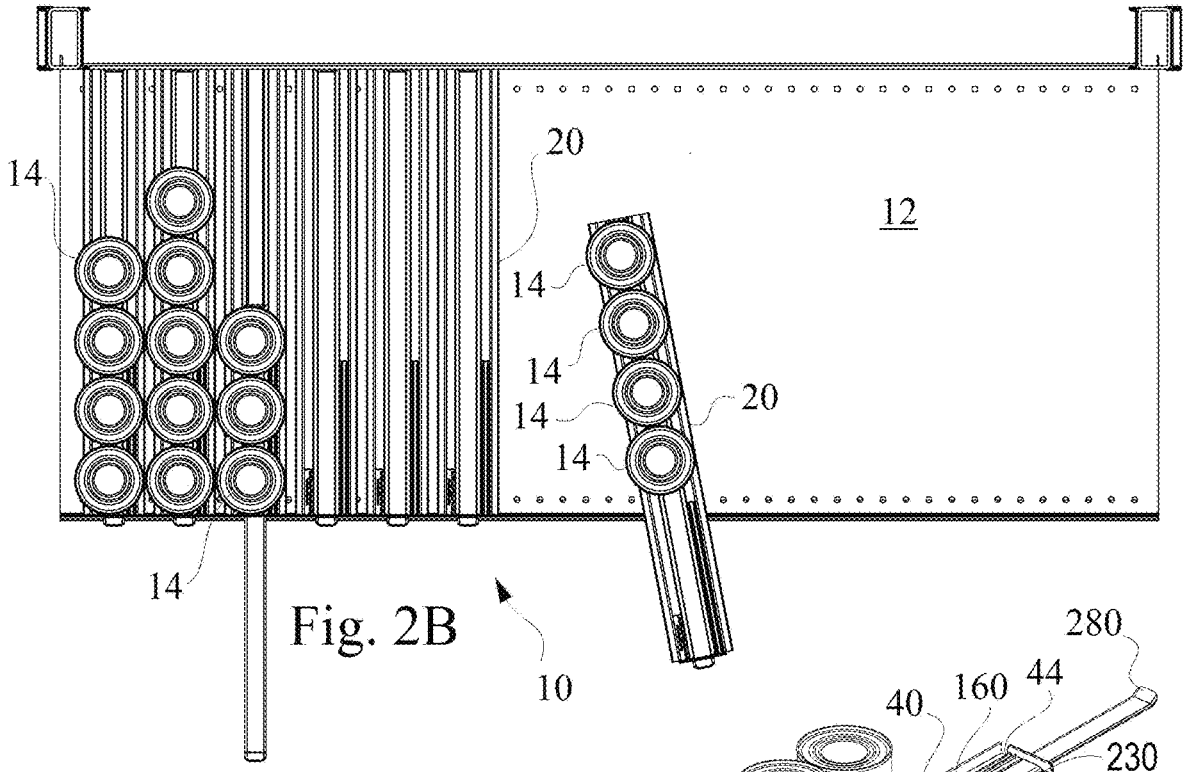
FIG. 2B is an overhead plan view of the shelf allocation and management system of FIG. 2A.

It is noted that, as used in this specification and the appended claims, the singular forms "a," "an", and "the" include plural referents unless expressly and unequivocally limited to one referent. For the purposes of this specification, unless otherwise indicated, all numbers expressing parameters used in the specification and claims are to be understood as being modified in all instances by the term "about." The terms "about" or "approximate" or similar terms within this application will generally mean within 10% unless otherwise noted. Accordingly, unless indicated to the contrary, the numerical parameters set forth in the following specification and attached claims are approximations that may vary depending upon the desired properties sought to be obtained by the present invention. The various embodiments and examples of the present invention as presented herein are understood to be illustrative of the present invention and not restrictive thereof and are non-limiting with respect to the scope of the invention.

The broad concepts of the operation of the shelf management system 10 of the present invention are found in U.S. Pat. No. 9,907,413, referenced herein as the '413 patent, which issued on Mar. 6, 2018, and which is incorporated herein by reference. The present application utilizes some common reference numerals as found in the '413 patent and these elements are described in greater detail therein. The following disclosure will concentrate on the improvements in a '413 patent type shelf management system 10 while the details of the common components can be found largely in the '413 patent. The present invention, as shown in FIG. 3A, provides a combination base 30 and side divider 40 where the base 30 and side divider 40 are manufactured as a single, integral part and where the side divider 40 cannot be moved in relation to the base 30 either in a lateral direction or in a forward and backward direction. The fixed divider 40 of the present invention marks a distinct difference compared to the '413 patent, which featured a base with a side divider that moved forward and backward in relation to the base. The embodiment of the present invention shall be called the "fixed side divider" unit 20.

A channel 150 is positioned substantially along the center top surface of base 30 and runs the full length of base 30. Puller 160 is positioned in and travels, forward and backward, along channel 150. Backstop 170 is attached to the rear end of puller 160 and handle 280 is attached to the front of puller 160. A fixed divider unit 20 supports one row of products 14 on a shelf 12 and presents those products 14 in much the same way as they are presented with no system 10. In fact, one object or aim in designing fixed side divider unit 20 was to make it as mechanically and visually unobtrusive as possible. When handle 280 is grasped and pulled then puller 160 and attached backstop 170 travel forward and backstop 170 makes contact with the rearmost product 14 resting on the base 30 and brings that product 14 and any other products on base 30 forward.

The base 30 features integral side divider 40 on one side. The opposite side of the base 30 is open with no side divider. Fundamental to the design of the present invention is that the units 20 are deliberately configured so that a small portion of the width of the products 14, i.e. the merchandise on a unit 20, hangs over the open side of the base 30. In the present example, the divider 40 is on the right side of the base 30 of fixed width unit 20 and the left side of the base 30 is open. Because the units 20 are installed in a series side-by-side the products 14 merchandised on a fixed divider unit 20 are supported on the right by side divider 40 of the subject unit 20 and are supported on the left by the side divider 40 of the unit 20 immediately adjacent and to the left. Because the products 14 slightly hang over the edge of the base 30, this design ensures that two side-by-side rows of products 14 merchandised by fixed divider units 20 are separated only by the thickness of a single divider 40, which, as will be explained below, can be made to be extremely thin, e.g. 0.040" (about the thickness of three business cards). Therefore the amount of lateral space occupied by the dividers 40 of the system 10 is so small as to be negligible. This is of crucial importance as most stores object to any divider system that occupies too much lateral space between merchandise rows.

The width of the base 30 will generally correspond to the width of the products 14, which may range from approximately 1.5" to 8.0" in width, with products 14 ranging from 2.0" to 4.5" in width being most common. The length of the base 30 will correspond to the shelf 12 depth, usually between 14" and 30" with 22" being a common shelf 12 depth. The height of side divider 40 varies depending on the required lateral support of the products 14 and will range from approximately 0.25" to 6.00" with 0.50" being a sufficient side divider 40 height to provide lateral support for many products 14 offered for sale in grocery stores, convenience stores, hardware stores and drug stores. In most cases, for a divider 40 to provide "lateral support" it need only prevent the product 14 from moving outside of its designated row during a typical stocking or row fronting procedure. Side divider 40 shall be as thin as possible. In one embodiment of the present invention side divider 40 shall be 0.50" tall and 0.040" thick so as to reduce to the greatest extent possible the amount of lateral space between product 14 rows occupied by side divider 40.

Fixed divider unit 20 features a top surface of base 30 that includes a channel 150 that is shaped so that it may receive a puller 160 that corresponds to the length of the base 30 and where a back-stop 170 is attached to the rear end of puller 160 and a handle 280 is attached to the front end of puller 160. Channel 150 is positioned substantially in the lateral center of base 30 although it may be positioned off-center without a reduction in function. Puller 160 would ordinarily be fashioned as a plastic strip more or less similar in width and thickness to an ordinary ruler. Channel 150 features overhanging locking rails 162 that allow forward and backward movement of puller 160 in channel 150 but prevent upward movement of puller 160 thereby preventing puller 160 from inadvertently separating from base 30. Handle 280 is fashioned to be larger in width and/or height than channel 150 which prevents handle 280 from traveling rearward of the front of base 30. In the embodiment where a unit 20 includes a front fence 230, puller 160 travels through an aperture in front fence 230 and puller handle 280 is wider and/or taller than the aperture thereby preventing the handle 280 from traveling rearward of front fence 230, which would create a nuisance as clerks would have to spend time locating and grasping the handle 280 in order to perform the row fronting function.

Back-stop 170 protrudes vertically at generally a right angle from the plane of puller 160. The height of back-stop 170 ranges from 0.50" to approximately 8.00", with 1.50" being a sufficient height to adequately engage and urge forward most merchandise containers. When puller 160 is drawn forward, the back-stop 170 engages the rearmost product 14 resting on top of the base 30 and that rearmost product 14 and any other products 14 on top of base 30 are therefore brought forward towards the front shelf 12 edge and into better view for customers to see and select for purchase.

The base 30 and integral side divider 40 are preferably made via plastic extrusion which, for this design, has advantages over plastic injection molding. On long parts such as those that would correspond to a typical store shelf depth (e.g. 20+ inches), plastic extrusion allows for thinner wall thicknesses to be achieved compared to injection molding. The ability to make thinner wall thicknesses is highly advantageous in that the side divider 40, which separates product 14 rows, can be made extremely thin (e.g. 0.030") thereby reducing or even eliminating any lateral displacement of the rows of products 14 by the side divider 40. A further advantage of the thinner wall thicknesses afforded by plastic extrusion is that less plastic may be used, which lowers the cost of production.

An additional advantage of plastic extrusion is the ease and lower cost with which different shelf 12 depths can be accommodated. Extruded parts may be easily cut to any length while, in contrast, different lengths may be achieved with injection molding only be interchanging different injection molds specifically designed for a particular length or size of a part. For example, in order to make 16", 18", 20", 22" and 24" of the combination base 30 (with side divider 40) via injection molding, five different molds or mold inserts would be required. This tool set may cost $50,000 or more, and each time a new length needs to be manufactured a time-consuming and costly change of the mold tool set must be undertaken. With extrusion, all five of these lengths may be made with the same extrusion die, which costs perhaps $5,000. The parts may be simply and rapidly cut to the desired length as they emerge from the extrusion die.

Figure 3B:
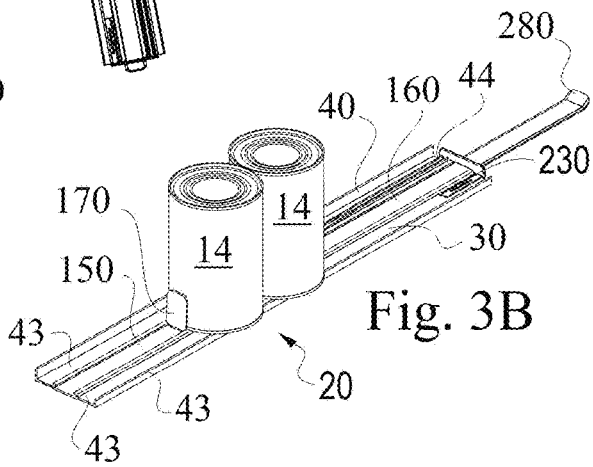
FIG. 3B is a schematic rear-perspective view of the shelf allocation and management unit of FIG. 3A showing a back-stop attached to a rear end of the puller and further showing the back-stop making contact with a product during a fronting operation.
Figure 3A:
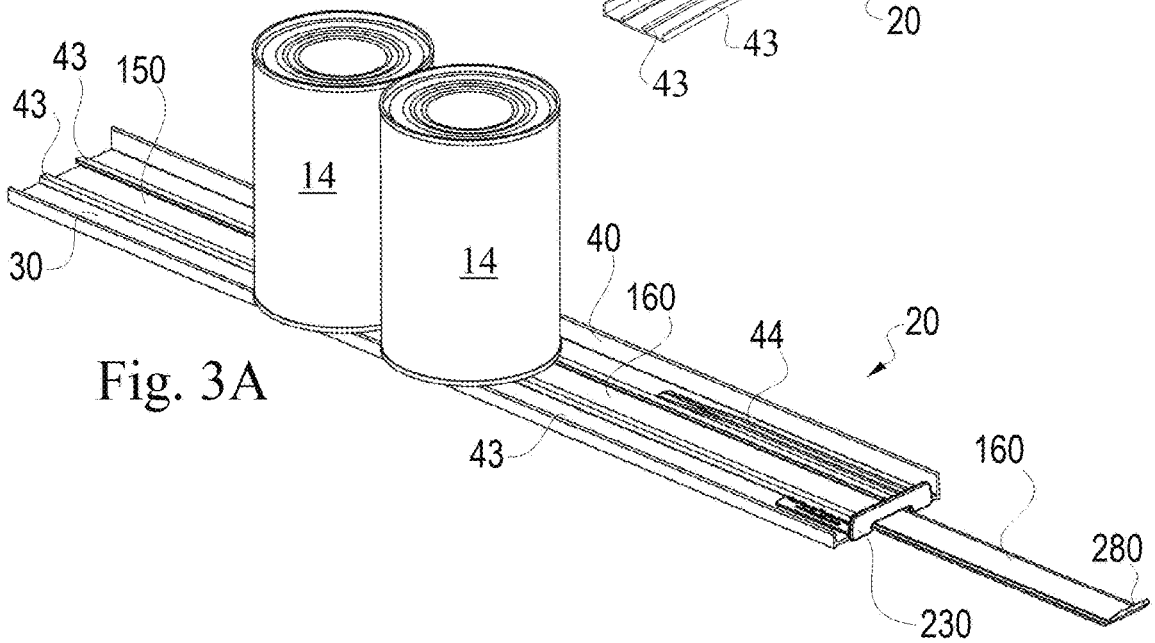
FIG. 3A is a schematic front-perspective view of an individual shelf allocation and management unit according to one embodiment of the present invention showing an integral base and divider, a channel in which a puller member travels, the puller member, base support rails, and a front fence which prevents products from falling off a front of the unit and base leveling ramps.

As shown in FIGS. 3A, 3B and 5A, the top surface of base 30 of fixed divider unit 20 features a support rail 43 or support rails 43 on which the products 14 rest and slide upon. These support rails 43 are ridges or rails that protrude upward from the top surface of base 30 from approximately 0.050" to 0.300" and generally run the full length of base 30. As described below, these support rails 43 impart a lateral tilt to the products 14 so that they are urged, through force of gravity, away from the open side of the base 30 of a unit 20 and towards the divider 40. The support rail or rails 43 are positioned on the side of the base 30 opposite the side of the base 30 to which the fixed divider 40 is attached. The divider 40 may be positioned on either the left or right side of the base 30 and the support rail or rails 43 may likewise be positioned on either side of base 30 so long as divider 40 and support rail 43 are on opposite sides of base 30. For the description below, the fixed divider unit 20 features divider 40 on the right and support rail or rails 43 on the left.

The lateral incline of the top surface of base 30 may be easily formed by having one support rail 43 distal from the divider 40 be slightly higher than the rail closest to the divider 40 (or higher than the base 30 surface), with the angle of incline measured between a line (or plane) connecting the tops of the rails 43 of the base 30 and the plane of the shelf 12. The amount of incline or tilt should be just enough to tilt the products 14 away from the open side of the base 30 but not so much as to disrupt the appearance of the products 14 or stack of products 14 or stacking of the products, namely less than 20 degrees and generally 3 to 5 degrees. Additionally, if there are more than two support rails 43 on the base 30 the height of the intermediate support rails 43 should also follow the defined angle of incline such that the tops of all the support rails 43 lie in a common plane such that all support rails 43 would be used to support the products 14.

In most cases, the divider 40 of a unit 20 immediately adjacent and to the left will provide lateral support to the products 14 on the subject unit 20, so the lateral tilt feature exists as insurance that the products 14 will stay on the base in the event that the subject unit 20 is a left end unit in a series of installed units 20 and therefore there is no unit 20 to the left (in some cases, there is no further shelf 12 to the left). The lateral tilt feature is also useful in cases where a unit 20 immediately to the left of subject unit 20 has moved out of position and away from the subject unit 20 for whatever reason and therefore the merchandise 14 on subject unit 20 would not be laterally supported on the left by a divider 40. In this case it is very useful for the products 14, not supported on the left by a divider 40, to be maintained on the subject unit 20 via the lateral tilt imparted to the products 14 by support rails 43. Further, although it is rare, stores will sometimes arrange merchandise on the shelves with deliberate gaps (e.g. 1") between product rows.

It is important that the products 14 are presented to the shopper in customary fashion, so the products 14 towards the front of the shelf 12 must be level (not tilted). To achieve this, the forward portion of the base 30 is modified so that, as the products 14 approach the front of the base 30, at a point approximately 6" rearward of the front, the lateral tilt of the products 14 is progressively reduced so that the front-most product 14, and ideally the product 14 immediately behind, appear as level. This leveling can be achieved two different ways. As seen in FIG. 5A the first method is to, at a point approximately 8" rearward of the front of the unit 20, progressively reduce the height of the support rail or rails 43 so that, at a point approximately 6" rearward of the front of unit 20 (and continuing all the way to the front of unit 20), the tops of the rails 43 are level with the base 30 surface with the effect being that the products 14 are presented as level.

A second method, as shown in FIGS. 3A and 4B, is to attach leveling ramp 44 which is a separate part approximately 5" to 8" long that is affixed to the front of the top surface of the base 30 and on the side opposite the side where support rail or rails 43 are positioned. As shown in FIGS. 3A and 4B, as products 14 move forward and make contact with the rear of leveling ramp 44 (at a point approximately 7" rearward of the front of the unit 20) the tilt of products 14 imparted by support rails 43 is countered by the progressively increasing height of leveling ramp 44 and therefore the lateral tilt of products 14 is reduced so that, at a point approximately 6" rearward of the front of the unit 20, the products 14 are presented as completely level. The use of leveling ramp 44 is an alternative to progressively reducing the height of support rails 43 towards the front of the unit 20 as described above. While it is possible to employ leveling ramp 44 in conjunction with reducing the height of support rails 43 towards the front of the unit 20, it would be easier and more cost effective to use one or the other method. The leveling ramp may be part of the front fence 230 that is attached to the base 30.

The units 20 are more useful if they can merchandise products 14 of varying widths. Many retail merchandising systems presently in use employ a strip attached to the front edge of the shelf onto which individual dividers (that run parallel to the shelf depth) are affixed and may be moved to the left or right along the strip to correspond to the widths of the products displayed. Another traditional method is a system where a base or tray features dividers attached to both the left and right sides and where the dividers can be moved closer or farther apart from each other to fit various product 14 widths. The fixed side divider unit 20 of the present invention employs a method, as shown in FIGS. 6A and 6B, to accommodate different product 14 widths which is to take advantage of the fact that, as long as approximately 70% of the width of the bottom of product 14 base is supported by the width of the base 30, then the products 14 are adequately supported and generally stable on the base 30. Therefore a base 30 of a fixed width may be used for a variety of different product 14 widths.

The range of product 14 widths in a typical grocery store is vast (approx. 1" to 16"), although the range of widths for the majority of food products (i.e. jars, cans and bottles) is rather narrow (approx. 2" to 3.50"). This narrow range of food product 14 widths and the fact that a portion of the left side of a product 14 can extend over the edge of the base 30 combine to afford the ability to accommodate most food product 14 widths with, for example, only two widths of fixed side divider unit 20. For example, as shown in FIG. 6B, a "small" base 30 width of 2.10" and a "medium" base 30 width of 2.70" would work with most food cans, jars and bottles in a typical grocery store. The 2.1" base 30 width works with packages from 2.10" to approximately 2.69" wide, and the 2.70" base 30 width works with packages from 2.70" to approximately 3.50" wide. Having only two sizes (e.g. a small and medium) of fixed divider unit 20 makes it easier for the store to order, install and to re-use units 20. Having only two sizes also makes it easier to produce and sell these fixed divider units 20 as there are fewer sizes to produce and to track in inventory, etc.

Using an example to illustrate the usefulness of the present invention, the traditional glass baby food jar is 2.20" wide. If this jar were merchandised on a fixed side divider unit 20 with a base 30 width of 2.10", as shown on the left in FIG. 6B, then approximately 0.10" of the jar would extend over the side (hang off) of the base 30. The jar is adequately supported by the base 30 and, although the appearance of the side of the jar extending over the edge of the base 30 is somewhat unconventional it is not visually objectionable or off-putting. As a demonstration of versatility, this same 2.10" wide fixed width base unit 20 could also be used for a larger baby food jar (2.30" wide), a jar of jam (2.50"), cooking spray can (2.30"), bottle of beer (2.44"), can of soda (2.25"), small cat food can (2.40"), 4 oz. can of mushrooms (2.57") and a spray paint can (2.60"), etc.

Some of the products 14 may be exactly the same width of base 30 but the majority will be wider so that the bottoms of products 14 will extend over the left side of base 30. Depending on the width of the product 14 and the width of the base 30, the products will extend over the side of the base 30 between approximately 0.10" and 1.40" with a "hang-off" of 0.40" being typical.

Whether the product 14 base is the same width as base 30, or if the product 14 base extends over the left edge of base 30, the product 14 will be contained laterally on the right by fixed side divider 40 of subject unit 20 and will be contained on the left via the tilt imparted by the support rails 43. The products 14 will be urged (or tilted) by support rails 43, through force of gravity, towards fixed side divider 40, so that the products 14 will tend to therefore be maintained in position on top of the base 30 of the fixed side divider unit 20 despite there being no side divider 40 attached to the left side of base 30.

As with most shelf management systems the fixed side divider units 20 are installed in series side-by-side with the merchandised packages 14 positioned so close to each other that they are virtually touching. In one embodiment of the present invention, the units 20 are not attached to the shelf 12 with mechanical fasteners or adhesives but rather simply rest on the shelf 12. The units 20 are generally at least partially full of products 14 and are therefore maintained in proper position by the weight of the products 14.

In a further embodiment, as shown in FIG. 8, magnets 180 may be attached to the underside of the units 20 thereby adhering the units 20 to a metal shelf 12. The vast majority of retail store shelves are made of steel. The magnets 180 would allow for a moderate degree of adhesion so that the units 20 would be prevented from being inadvertently moved out of position but would not present so much adhesion that re-positioning the units 20 would be difficult. Individual units 20 featuring magnets 180 provide additional stability and support for the products 14 being merchandised as the products 14 on a particular unit 20 would be laterally supported on the right by side divider 40 of the subject unit and would be more positively supported on the left by side divider 40 of an immediately adjacent unit 20 to the left if both units 20 are prevented from inadvertently moving apart from each other by the adhesion to the shelf imparted by magnets 180.

Figure 11:
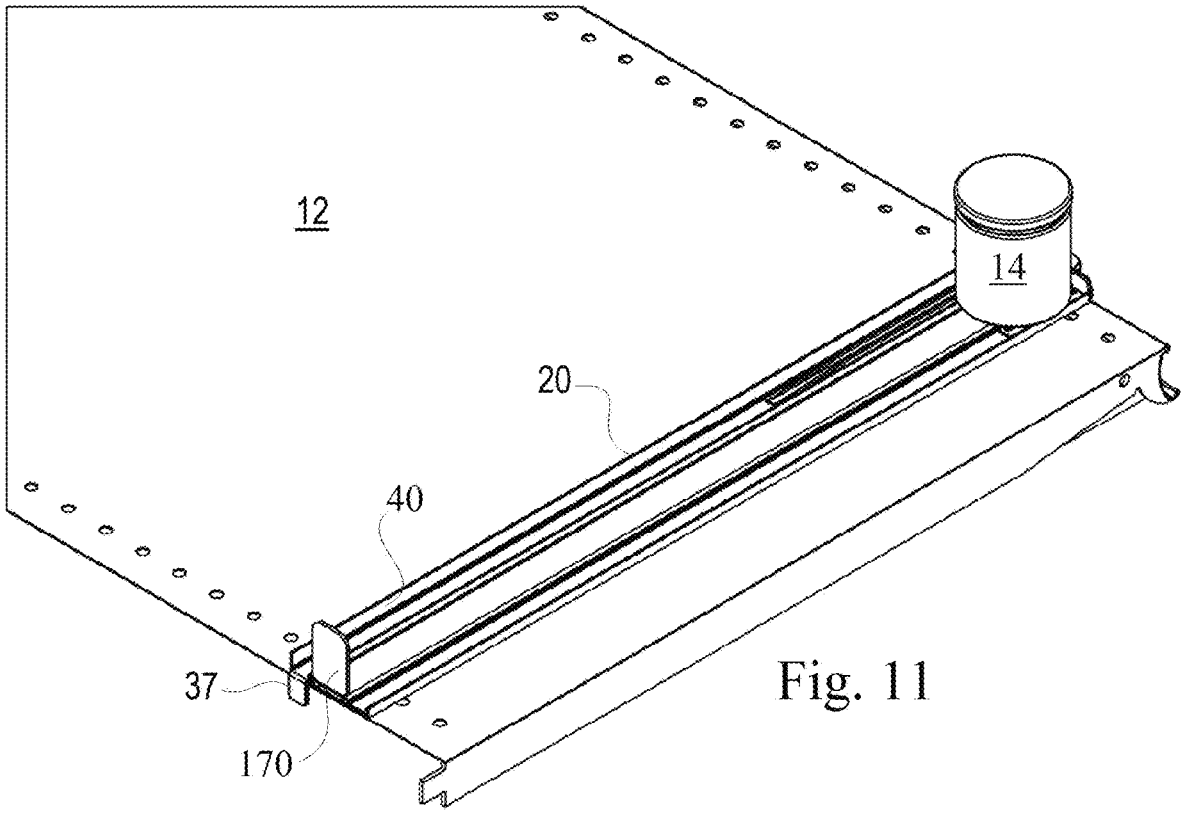
FIG. 11 is a schematic perspective view of a shelf allocation and management system according to an embodiment of the present invention showing a catch attached to the rear end of the base of the unit and making arresting contact with the rear of a shelf.

In a further embodiment of the present invention, as shown in FIG. 11, the units 20 may feature a rear catch 37 the purpose of which is to make positive arresting contact with the rear edge of the shelf 12 thereby preventing forward movement of the base 30 of a unit 20. The rear catch 37 is attached to the rear end of base 30 and protrudes downward approximately 0.50" from the bottom of base 30 at more or less a 90-degree angle in relation to the plane of the base 30 surface. The rear catch 37 may extend downward below the bottom of the base 30 from 0.20" to 1.00" with 0.50" being a typical extension length. The extension length of rear catch 37 should be long enough to provide significant arresting contact with the rear edge of the shelf 12 but short enough so that the unit 20 may be lifted up and away from the shelf 12 without undue effort. When the shelf allocation and management units 20 are placed on the shelf 12 during installation, the bases 30 are positioned so that the rear catch 37 is seated against and touching the rear shelf 12 edge such that the bases 30, when installed in a series side-by-side, are maintained in alignment with respect to the rear edge of the shelf 12, and, therefore, are maintained in alignment with the front edge of the shelf 12.

In addition to maintaining the shelf management units 20 in proper front-to-back alignment, the rear catch 37 prevents the units 20 from moving forward when puller 160 is pulled forward as when actuating the fronting mechanism. Objectionable forward movement may mean movement of the front of the base 30, for example, one-half inch forward of the front of the shelf 12. If the units 20 in a system 10 move inadvertently forward during row fronting then the store clerks must take extra time to re-position the units 20, which is wasted time. A further advantage of the rear catch 37 preventing unwanted forward movement of the units 20 during row fronting, is that store clerks need not use their free hand to hold the unit 20 steady when pulling the puller 160 forward. This frees up the clerk's second hand so that an adjacent shelf management unit 20 may be fronted enabling two units 20 to be fronted simultaneously.

Figure 10A:
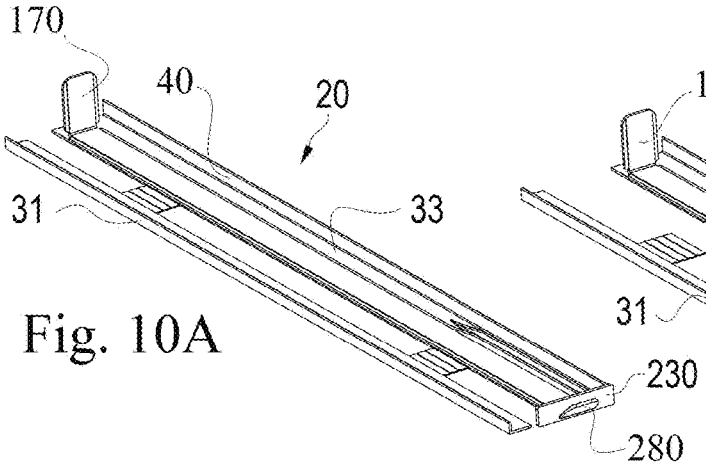
FIG. 10A is a schematic perspective elevation view of a shelf allocation and management unit according to one embodiment of the present invention showing an adjustable width base for the unit.
Figure 10B:
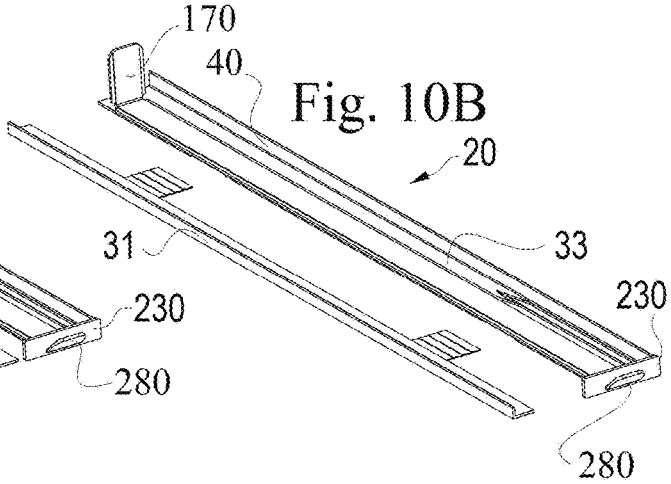
FIG. 10B is a schematic exploded perspective view of the shelf allocation and management unit shown in FIG. 10A.

In a further embodiment, as shown in FIGS. 10A and 10B, the fixed divider unit 20 features a base 30 that is adjustable in width, with two halves 31 and 33, so that the unit 20 can be adjusted to accommodate products 14 of various widths. A width-adjustable unit 20 could be adjusted to accommodate most products 14 in a store and this would simplify the ordering process of the units 20 for stores. For example, a store with 80 varieties of peanut butter and jelly jars that range from 2.4" to 3.6" wide could simply order 80 width-adjustable units 20 as opposed to, say, 30 small and 50 medium fixed-width units 20 of the type described above. An adjustable-width unit 20 would increase versatility of the system 10 and may also simplify production and inventory accounting for the manufacturer of the units 20. As shown in FIGS. 10A and 10B, width adjustability could be achieved by essentially splitting the base 30 into two halves 31 and 33 along the length of base 30 with one half 31 featuring male projections which would insert at various positions into female channels on the other half 33 of base 30. This is one among a number of methods that could be used to achieve width-adjustability.

Divider 40 of fixed width unit 20 shall be between 0.30" and 6.0" high, or high enough to provide lateral support to the products 14. The thickness of divider 40 will range from 0.020" to 0.125". Stores prefer that a shelf management system creates no disruption to the number or rows (or facings) of products 14 that may be fit on a shelf 12. If a divider 40 is too thick then the accumulation of the divider 40 thicknesses of a series of installed units 20 will displace and possibly eliminate a row or multiple rows of products 14 which the stores find objectionable. Therefore, it is much preferred that the divider (or dividers) of a shelf management system be very thin and ideally be no thicker than the space that normally exists between product 14 rows without any system in place. Generally, the normally existing space between product 14 rows is between 0.050" and 0.10", with 0.060 being typical. To minimize or eliminate row disruption the divider 40 of fixed side divider unit 20, shall be between 0.020" and 0.050" thick with 0.040" providing a good blend of thinness and strength. As shown in FIGS. 6A and 6B, a divider 40 at a 0.040" thickness will cause no facing loss and therefore no disruption to the store's intended arrangement of products on the shelf 12.

A divider 40 that is 0.50" high provides sufficient lateral support for a significant proportion of products 14 found in a typical grocery store. Many products 14 are not stacked one atop the other, and in many cases where products are stacked they are designed to "nest" so that one product 14 stacked atop another product 14 is prevented from falling off owing to the top the product featuring a "cup" and the bottom of the product featuring a corresponding male shape that fits into and gently locks into the female cup. So in most cases a very low divider of 0.050" high is sufficient to prevent inadvertent lateral movement of the products 14—even if stacked—and thereby sufficient to maintain the products 14 in their designated row.

Stores object to a shelf management system 10 that reduces the amount of shelf depth (the space measured from the front edge of shelf 12 to the back edge of shelf 12) available for product 14 display. The plane of back-stop 170 of fixed width unit 20 is designed to be substantially aligned with the perpendicular plane that would extend from the rear edge of shelf 12, and the front fence 230 of a fixed width unit 20 is likewise substantially aligned with the perpendicular plane that extends from the front edge of shelf 12. Therefore, the full depth of the shelf 12 is available for product 14 display even with a unit 20 installed. The fixed side divider units 20, then, do not cause any loss of "pack-out" or a loss of the number of products 14 that can be positioned along the depth of the shelf 12.

Figure 12:
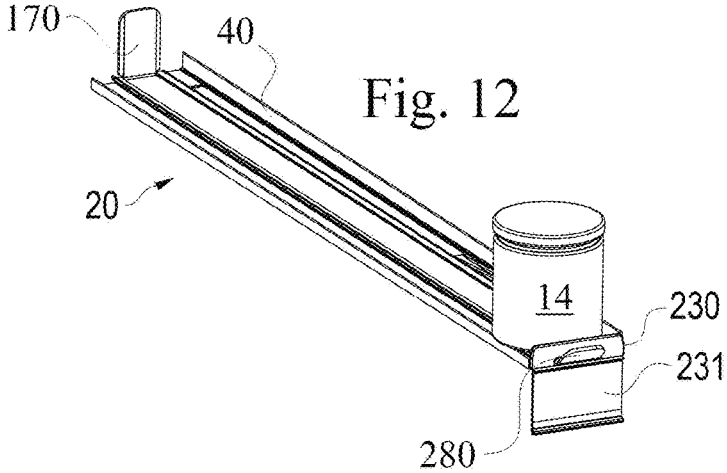
FIG. 12 is a schematic front-perspective view of an individual shelf allocation and management unit according to one embodiment of the present invention showing a price tag holder attached to the front of the unit.

Although stores customarily prefer to affix product 14 price tags/labels to the front of the shelf 12 for identifying not only the price information but also designating the position of a row of products 14 on the shelf 12, a further embodiment of the fixed side divider unit 20 features price tag holder 231 attached to the front of base 30, as shown in FIG. 12. The tag holder may be formed as part of the front fence 230 or as a separate element. An advantage of attaching price tag holder 231 to unit 20 is that the price and other product 14 information is always positioned immediately beneath the product 14 row so any confusion about the price or other product 14 information that may result from the price label not being aligned with the product 14 row is eliminated.

As shown in FIG. 3A, a further embodiment of fixed side divider unit 20 features front fence 230 which acts to prevent products 14 from falling off the front of base 30 when the products 14 are brought forward during row fronting. Front fence 230 is attached to the front of base and protrudes at substantially a right angle from the plane of base 30 and extends anywhere from approximately 0.20' to 1.5" with 0.50" being a sufficient height to prevent most products 14 from inadvertently sliding off of the front of base 30.

To maximize the space available for display of merchandise 14, in many cases stores allow only a very small amount of vertical space between the top of products 14 on the subject shelf 12 and the next shelf 12 immediately above. Sometimes this space is only 2"-3" making it very difficult for store personnel to determine how many cans or jars, etc. are in a given row (behind the one or two that are easily visible at the front). The vertical spacing is so minimal that often the middle and rear of the shelf is quite dark. Occasionally store personnel will use a flashlight to help see how full a row is. This makes it time consuming and tedious for store clerks, when ordering new stock, to gauge inventory levels.

Figure 9A:
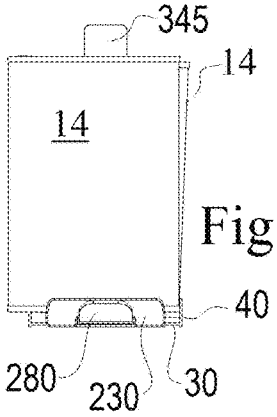
FIG. 9A is a schematic front elevation view of a shelf allocation and management unit according to one embodiment of the present invention and showing an optional inventory indicator flag protruding above the rearmost can positioned on the unit.
Figure 9B:
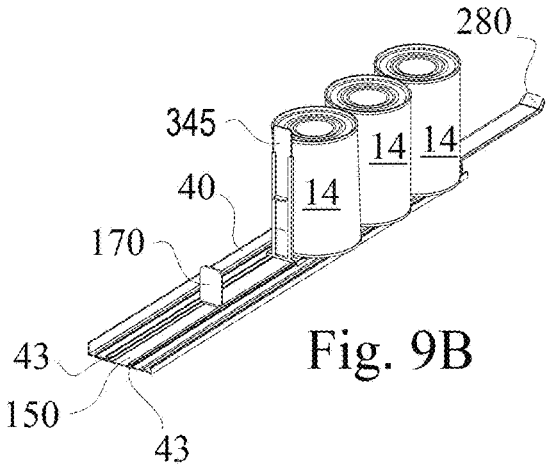
FIG. 9B is a schematic rear perspective view of the shelf allocation and management unit shown in FIG. 9A showing the inventory indicator flag touching the back of the rearmost can and further showing that the inventory indicator flag may be urged forward by the backstop but which stays with (touching) the rearmost piece of merchandise when the backstop is returned to the staring position.

To address this problem, as shown in FIGS. 9A and 9B, a further embodiment of the present invention features a highly visible inventory flag 345 that signals the stock level of products on a unit 20. The inventory flag 345 would be a member positioned in front of back-stop 170 where the flag 345 would be maintained in position immediately behind (ideally touching) the rearmost product 14 in a row of products 14 positioned on a unit 20. The flag 345 would protrude approximately 1.50" above the top of the rearmost product 14 in the row and would be either white or some other bright reflective color so could easily be seen without the use of a flashlight or otherwise causing the clerk to strain to see. The flag 345 would travel in a channel or channels on the top surface of the base, and would be urged forward when puller 160 is drawn forward but, unlike backstop 170 that is attached to puller 160, the flag 345 would not return to the rear of the unit 20 when the puller is pushed back to the normal position but would rather stay immediately behind the rearmost product 14.

One advantage of the present invention is that the system 10 and each unit 20 may be substantially manufactured by plastic extrusion. The bases 30 and integral side divider 40 of each unit 40 described above can be formed by extrusion and cut to a desired length. The bases 30 may include a subsequent processing step such as reducing the height of the leading end of the rail 43 as shown in FIG. 5A and/or adding the front fence 230 (with optional leveling ramp 44). The front fence 230 and leveling ramp 44 would typically not be formed by extrusion, however it is possible that the front fence 230 (without leveling ramp 44) may be formed with the cutting of the extruded base to length and then bending the front fence 230 into position after cutting. The puller 160 and backstop 170 and handle 280 may also be formed by extrusion and cut to length with the backstop 170 and handle 280 formed in a subsequent bending operation. The rear catch 37 could be formed as a separate extruded piece attached to the base or part of the extruded base 30 that is bent after cutting to length. The flag 345 and magnets 180, if used, also would typically not be extruded. In the width adjustable base 30 of FIGS. 10A and 10B the base halves 31 and 33 (with divider 40) may be formed by extrusion, but the interlocking tabs and locking recesses would not be extruded but added as separate components in a subsequent processing step. The system 10 and each unit 20 are considered to be substantially manufactured by plastic extrusion as the essential components, namely the base 30 and dividers 40 and puller 160 may be formed by extrusion to any desired length.

As described above the present claimed invention provides a bottom supporting shelf allocation and management system 10 for allocating shelf space among rows of products 14. The system 10 as described above includes a plurality of adjacent shelf allocating and managing units 20, each unit 20 associated with at least one row of products 14 wherein each unit 20 is considered to be substantially manufactured by plastic extrusion. Each unit 20 includes a base 30 that is configured to be extrudable and substantially corresponding in length to a depth of a shelf 12 where the base 30 is adapted to rest on the shelf 12 and to support the at least one row of products 14. The unit 20 includes an integral perpendicular side divider 40 coupled to the base and extending substantially the same length as the base, and can be formed by extrusion. The side divider 40 extends vertically above the base 30 and is attached to the side edge of the base 30 and wherein the coupling of the base 30 and side divider 40 prevents movement of the side divider 40 in relation to the base 30. An uppermost surface (top of rail 43 on the side opposite the divider 40) on a side of the base 30 opposite the side of the base 30 to which the side divider 40 is coupled is lower than a top surface of the side divider 40. Each unit 20 includes a puller 160 that travels in a channel 150 on a top surface of the base 30 and along the length of the base 30, a backstop 170 attached to the rear of the puller 160 and extending laterally across a part of the top surface of the base 30 which is configured, when the puller 160 is manually drawn forward, to make contact with a rearmost product 14 resting on the base 30 and push the rearmost product 14 and any other products 14 on the base forward.

It is understood, therefore, that this invention is not limited to the particular embodiments disclosed, but it is intended to cover modifications that are within the spirit and scope of the invention, as defined by the appended claims and equivalents thereto.

What is claimed is:

1. A bottom supporting shelf allocation and management system for allocating shelf space among rows of products, the system comprising:

a plurality of adjacent shelf allocating and managing units, each unit associated with at least one row of products, wherein each unit includes a) a base substantially corresponding in length to a depth of a shelf where the base is adapted to rest on the shelf and to support the at least one row of products, b) an integral perpendicular side divider coupled to the base and extending substantially the same length as the base, wherein the side divider extends vertically above the base and is attached to the side edge of the base and wherein the coupling of the base and side divider prevents movement of the side divider in relation to the base, and wherein an uppermost surface on a side of the base opposite the side of the base to which the side divider is coupled is lower than a top surface of the side divider, c) a puller that travels in a channel on an upper surface of the base and along the length of the base, a backstop attached to the rear of the puller and extending laterally across a portion of the upper surface of the base which is configured, when the puller is manually drawn forward, to make contact with a rearmost product resting on the base and push the rearmost product and any other products on the base forward, wherein the channel includes overhanging locking rails configured to allow forward and backward movement of the puller in the channel and configured to prevent upward movement of puller.

2. The bottom supporting shelf allocation and management system for allocating shelf space among rows of products according to claim 1 wherein the system is configured so that the individual units are installed in series side-by-side and wherein each shelf allocating and managing unit is configured so that a portion of the products can hang off the side of the base opposite the side to which the divider is attached.

3. The bottom supporting shelf allocation and management system for allocating shelf space among rows of products according to claim 2 further including at least one rail on the base configured to impart a lateral tilt to the products supported on the base for at least a portion of the base where the lateral tilt urges the products towards the side divider.

4. The bottom supporting shelf allocation and management system for allocating shelf space among rows of products according to claim 3 wherein the at least one rail on the base configured to impart a lateral tilt to the products supported on the base imparts a lateral tilt to the products positioned in the middle and rear of the base and wherein products positioned at the front of the base are level.

5. The bottom supporting shelf allocation and management system for allocating shelf space among rows of products according to claim 4 further including a magnet affixed to the base.

6. The bottom supporting shelf allocation and management system for allocating shelf space among rows of products according to claim 4 further including a base that is adjustable in width.

7. The bottom supporting shelf allocation and management system for allocating shelf space among rows of products according to claim 4 further including a front fence that prevents products from traveling off of the front of the base.

8. The bottom supporting shelf allocation and management system for allocating shelf space among rows of products according to claim 4 further including a flag that signals the position of the rearmost product supported on the shelf allocation and managing unit.

9. The bottom supporting shelf allocation and management system for allocating shelf space among rows of products according claim 8 further including a rear catch configured to engage a rear edge of the shelf.

10. The bottom supporting shelf allocation and management system for allocating shelf space among rows of products according to claim 4 further including a rear catch configured to engage a rear edge of the shelf.

11. The bottom supporting shelf allocation and management system for allocating shelf space among rows of products according to claim 4 further including a holder for a price tag or other product identifying information attached to the front of the unit.

12. The bottom supporting shelf allocation and management system for allocating shelf space among rows of products according to claim 1 further including a front fence that prevents products from traveling off of the front of the base, and a plurality of support rails extending upwardly from the base on which the products rest and slide upon including support rails extending from the overhanging locking rails.

13. The bottom supporting shelf allocation and management system for allocating shelf space among rows of products according to claim 1 wherein the base, side divider and puller of each unit are extruded, and further including a plurality of support rails extending upwardly from the base on which the products rest and slide upon including support rails extending from the overhanging locking rails.

14. A bottom supporting shelf allocation and management unit associated with at least one row of products, wherein the unit comprises:

an extruded base substantially corresponding in length to a depth of a shelf where the base is adapted to rest on the shelf and to support the at least one row of products;

an extruded side divider integral with and perpendicular to the base, wherein the side divider extends vertically above the base and is attached to the side edge of the base and wherein the coupling of the base and side divider prevents movement of the side divider in relation to the base, and wherein an uppermost surface on a side of the base opposite the side of the base to which the side divider is coupled is lower than a top surface of the side divider;

an extruded puller that travels in a channel on an upper surface of the base and along the length of the base, a backstop attached to the rear of the puller and extending laterally across a portion of the upper surface of the base which is configured, when the puller is manually drawn forward, to make contact with a rearmost product resting on the base and push the rearmost product and any other products on the base forward, wherein the channel includes overhanging locking rails configured to allow forward and backward movement of the puller in the channel and configured to prevent upward movement of puller.

15. The bottom supporting shelf allocation and management unit according to claim 14 wherein the shelf allocating and managing unit is configured so that a portion of the products can hang off the side of the base opposite the side to which the divider is attached.

16. The bottom supporting shelf allocation and management unit according to claim 14 further including at least one rail on the base configured to impart a lateral tilt to the products supported on the base for at least a portion of the base where the lateral tilt urges the products towards the side divider.

17. The bottom supporting shelf allocation and management unit according to claim 14 further including a front fence that prevents products from traveling off of the front of the base, and further including a plurality of support rails extending upwardly from the base on which the products rest and slide upon including support rails extending from the overhanging locking rails.

18. The bottom supporting shelf allocation and management unit according to claim 14 further including a flag that signals the position of the rearmost product supported on the shelf allocation and managing unit, and further including a plurality of support rails extending upwardly from the base on which the products rest and slide upon including support rails extending from the overhanging locking rails.

19. The bottom supporting shelf allocation and management unit according claim 14 further including a rear catch configured to engage a rear edge of the shelf.

20. The bottom supporting shelf allocation and management unit according to claim 14 further including a holder for a price tag or other product identifying information attached to the front of the unit.

* * * * *